US008303097B2

(12) United States Patent
Chen

(10) Patent No.: US 8,303,097 B2
(45) Date of Patent: Nov. 6, 2012

(54) INK CARTRIDGE FOR INK JET PRINTER

(75) Inventor: Baoquan Chen, Zhuhai (CN)

(73) Assignee: Zhuhau Ninestar Management Co., Ltd., Gunagdong (CN)

( * ) Notice: Subject to any disclaimer, the term of this patent is extended or adjusted under 35 U.S.C. 154(b) by 0 days.

(21) Appl. No.: 13/464,781

(22) Filed: May 4, 2012

(65) Prior Publication Data

US 2012/0218357 A1 Aug. 30, 2012

Related U.S. Application Data

(63) Continuation of application No. PCT/CN2010/074937, filed on Jul. 2, 2010.

(30) Foreign Application Priority Data

Nov. 9, 2009 (CN) ..... 2009 2 0260198 U

(51) Int. Cl.
*B41J 2/175* (2006.01)

(52) U.S. Cl. ..... 347/86

(58) Field of Classification Search ..... 347/7, 19, 347/85, 86, 87
See application file for complete search history.

(56) References Cited

U.S. PATENT DOCUMENTS

| | | | | |
|---|---|---|---|---|
| 5,825,387 | A | 10/1998 | Cowger et al. | |
| 6,364,472 | B1 | 4/2002 | Hmelar et al. | 347/85 |
| 6,386,693 | B1 | 5/2002 | Michele et al. | 347/86 |
| 6,793,329 | B2 * | 9/2004 | Battey et al. | 347/86 |
| 7,226,153 | B2 * | 6/2007 | Sasaki | 347/86 |

FOREIGN PATENT DOCUMENTS

| | | | |
|---|---|---|---|
| CN | 1410274 | A | 4/2003 |
| CN | 101491975 | A | 7/2009 |
| EP | 1 839 882 | A1 | 10/2007 |
| EP | 2 095 959 | A1 | 9/2009 |
| JP | 59-192573 | | 10/1984 |

OTHER PUBLICATIONS

International Search Report of international Application No. PCT/CN2010/074937, dated Sep. 9, 2010.

* cited by examiner

*Primary Examiner* — Anh T. N. Vo
(74) *Attorney, Agent, or Firm* — J.C. Patents

(57) ABSTRACT

The present invention relates to an ink cartridge for an ink jet printer, comprising an ink storage chamber formed by a concave housing (3) and a flexible and deformable film (2), a fluid outlet (5) connected with a fluid inlet of the printer, an information storage device (11), a locking mechanism (6) and a detection mechanism for detecting ink consumption. The detection mechanism comprises a lever component (4) positioned in the ink storage chamber and a force transmission component (10) positioned on the housing, made of deformable material and communicated with the ink storage chamber. This ink cartridge can solve the technical problems that the conventional detection mechanism of the ink cartridge of the ink jet printer is complex and low in reliability.

5 Claims, 3 Drawing Sheets

INK CARTRIDGE FOR INK JET PRINTER

CROSS-REFERENCE TO RELATED APPLICATIONS

This application is a continuation of International Application No. PCT/CN2010/074937 filed on Jul. 2, 2010, which claims the priority benefit of Chinese Patent Application No. 200920260198.1, filed on Nov. 9, 2009. The content of the above identified application is incorporated herein by reference in its entirety.

FIELD OF THE TECHNOLOGY

The present invention relates to an ink cartridge for an ink jet printer.

BACKGROUND

With the development of modern science and technology, ink jet printers with their reliable printing quality and low price are accepted by ordinary customers. In one type ink jet printer, an ink cartridge installation part of the printer is provided with a pressure detection device for detecting ink consumption in the ink cartridge and an electric contact part engaged with an electric contact in the ink cartridge, wherein the electric contact can move in a certain range.

U.S. Pat. Nos. 5,825,387, 6,364,472 and 6,793,329 have disclosed an ink cartridge for this type printer, and the ink cartridge is a container with elongated shape defined by opposite side walls and opposite end walls; the first feature is characterized by the model of the ink held in the ink container; and the second feature, different from the first one, is characterized by the ink color corresponding to the ink held in the ink container. The ink cartridge comprises an ink reservoir, a pump, a one-way valve, a fluid outlet and an electric contact surface part, wherein the ink reservoir is flexibly connected to a base plate and configured to receive ink, and forms fluid connection with a fluid inlet of the pump; the pump moves linearly and is provided with a variable volume chamber and integrated on the base plate, the ink is sucked from the ink reservoir through the fluid inlet of the pump when the bias pressure faces a volume expansion direction, and the ink is pressed out when the pump moves towards a volume shrinkage direction; the one-way valve is arranged at the inlet of the pump to allow the ink to flow out from the ink reservoir through the inlet of the pump and limit the ink to flow back to the ink reservoir; the fluid outlet is formed in the base plate; and the electric contact surface part is determined by a groove in a housing of the replaceable ink reservoir, and the groove is provided with a first inner surface serving as an engaging part and a second inner surface provided with a plurality of electric contacts, so that the electric contacts of the printer are engaged with the electric contacts of the ink cartridge without applying any pressure.

The complex pump structure adopted in the ink cartridge for supplying ink and being as an ink detection part comprises a plurality of elements such as a pump cap, the one-way valve, a spring and the like, and the physical properties and the mutual matching relationship of the elements increase many instable factors, for example, if the one-way valve at the inlet of the pump is not closed completely during ink supply, the ink flows back to the ink reservoir from the pump, so that the ink supply at the fluid outlet is insufficient and the print quality is influenced. Great difficulties are caused for the control of product quality, meanwhile, the manufacturing cost of the product is increased, and the detection mechanism is complex and low in precision.

In addition, the ink cartridges used in color ink jet printers generally include several ink cartridges filled with ink of different colors. In order to prevent assembly error of the ink cartridges, a corresponding identification characteristic is made on each model of the ink cartridges. However, when the problem of assembly error is solved, the production costs, comprising the manufacturing cost of moulds and the material control cost during the production process and the like, of the ink cartridge products are increased.

SUMMARY

The present invention provides an ink cartridge for an ink jet printer for solving the technical problems that the conventional detection mechanism of the ink cartridge of the ink jet printer is complex and low in reliability.

In order to solve the technical problems, the present invention adopts the following technical solution:

An ink cartridge for an ink jet printer, comprising an ink storage chamber formed by a concave housing and a flexible and deformable film, a fluid outlet connected with a fluid inlet of the printer, an information storage device, a locking mechanism, and a detection mechanism for detecting ink consumption, wherein the detection mechanism comprises a lever component positioned in the ink storage chamber and a force transmission component positioned on the housing, made of deformable material and communicated with the ink storage chamber, when ink is received in the ink storage chamber, the force transmission component transmits a pressure applied by a pressure detection device of the printer to the lever component by means of deformation itself, and the lever component limits further movement of the pressure detection device of the printer to show that the ink cartridge has the ink; and when the ink in the ink storage chamber is gradually consumed to a predetermined value, the lever component is pressed by the flexible and deformable film and moves to a predetermined position, thus the force transmission component cannot transmit the pressure applied by the pressure detection device of the printer to the lever component, and the pressure detection device of the printer freely stretches in a predetermined range to prompt that the ink in the ink cartridge is used up.

The housing is provided with an elastic wall, and the information storage device is arranged on the elastic wall; and when the ink cartridge is installed in an installation position of the printer, the information storage device is engaged with a corresponding electric contact in the printer under a pretightening force applied by the elastic wall to form electric connection.

The ink cartridge further comprises positioning ribs arranged at two sides of the housing.

When the ink cartridge is inserted into a specified position, the locking mechanism is caught in a corresponding part at the fluid inlet of the printer.

The positioning ribs at the two sides of the housing are symmetrical.

After the above technical solution is adopted, because elements such as a spring, a one-way valve and the like in the pump of the detection mechanism are eliminated, the production process is simple, the detection reliability is improved, and the technical problems that the conventional detection mechanism of the ink cartridge of the ink jet printer is complex and low in reliability are solved. In addition, because the information storage device is engaged with the corresponding electric contact at a receiving position of the printer under the pretightening force applied by the elastic wall, the reliable electric connection can be formed without a first inner surface specially serving as an engaging part, and the technical problem that the information storage device is engaged with the corresponding electric contact in the printer to form the electric connection only when the ink cartridge of the conventional ink jet printer must be provided with a special engaging part is solved. Secondly, substantially symmetrical guiding and positioning ribs are arranged at the two sides of the housing of the ink cartridge and extend outwards from the two sides of the housing of the ink cartridge, and the ribs of various ink cartridges of different models have a uniform shape, so that a same mould can be adopted for producing the ink cartridges of different models, the cost of the mould is saved and the production process is simplified; and the ink cartridges of different models are identified by adopting packages. Finally, when the ink cartridge is inserted into the specified position, the locking mechanism is caught in the corresponding part at the fluid inlet of the printer, so that the ink cartridge is prevented from popping up under hit of the pressure detection device.

| Reference signs: | | | |
|---|---|---|---|
| 1—surface cover | 2—deformable film | 3—concave housing | 4—lever component |
| 5—fluid outlet | 6—locking mechanism | 7—sealing ring | 8—elastic wall |
| 9—headstock | 10—force transmission component | 14—ribs | 12—small spring |
| 13—pressure detection device of printer | | 11—information storage device | |

DETAILED DESCRIPTION

In order to make the purposes, technical solution and advantages of the embodiments of the present invention clearer, the technical solution in the embodiments of the present invention will be clearly and completely described hereinafter according to the drawings of the present invention. Obviously, those described here are not all but only a part of embodiments of the present invention. On the basis of the embodiments of the present invention, all other embodiments obtained by the ordinary skill in the art without any creative work should fall in the protection scope of the present invention.

Figure 1:
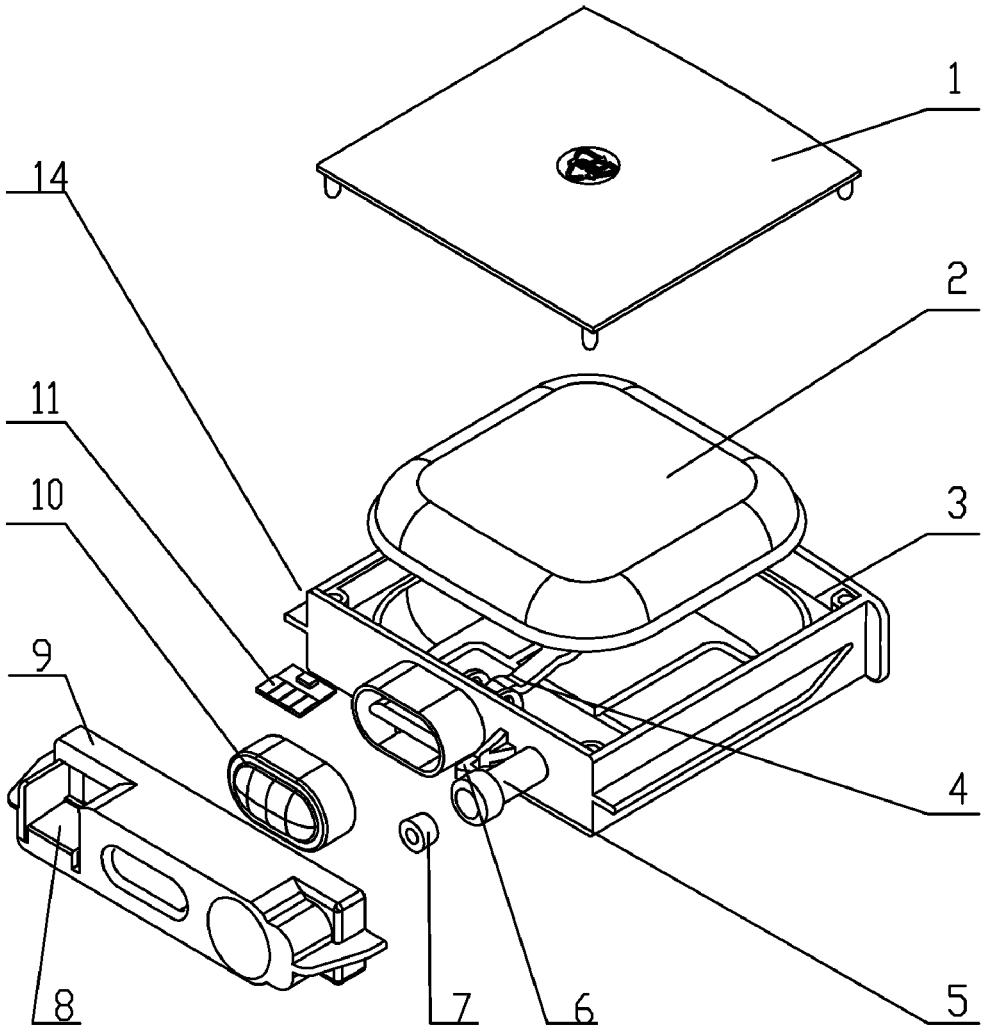
FIG. 1 is an explosive structural schematic diagram of an ink cartridge of an embodiment of the present invention.

FIG. 1 shows an explosive structural schematic diagram of an ink cartridge of an embodiment of the present invention, and the a structure of the ink cartridge comprises a surface cover 1, a deformable film 2, a concave housing 3, a lever component 4, a fluid outlet 5, a locking mechanism 3, a sealing ring 7, an elastic wall 8, a headstock 9, a force transmission component 10, an information storage device 11, ribs 14 and the like.

The deformable film 2 and the concave housing 3 form an ink storage chamber of the ink cartridge, the deformable film 2 substantially follows the concave shape of the concave housing 3 with consumption of the ink, and the surface cover 1 is configured to protect the deformable film 2. The lever component 4 is positioned in the ink storage chamber for detecting the consumption of the ink in the ink storage chamber. The fluid outlet 5 is configured to engage with a fluid inlet of the printer and arranged with the sealing ring 7. When the ink cartridge is installed in an installation part of the printer, a protruding part of the fluid inlet of the printer pierces the sealing ring, so that fluid communication is realized; and when the ink cartridge is taken out of the installation part of the printer, the sealing ring 7 seals a hole formed by the protruding part of the fluid inlet of the printer under elasticity itself. The locking mechanism 6 is caught in an opening at the fluid inlet of the printer when the ink cartridge is inserted into the specified position, so that the ink cartridge is prevented from popping up under hit of a pressure detection device of the printer. The information storage device 11 is arranged on the elastic wall 8. When the ink cartridge is installed in the installation part of the printer, the elastic wall 8 presses a movable electric contact of the printer to a fixed position by using elasticity itself, so that engagement between an electric contact in the information storage device and the electric contact of the printer is realized. The headstock 9 is configured to fix the force transmission component 10 and fixed on the concave housing 3 by adopting a welding manner. The force transmission component 10 is made of deformable material and configured to transmit the pressure from the pressure detection device of the printer. The ribs 14 extend outwards from two sides of the housing of the ink cartridge. When the ink cartridge is inserted into the ink cartridge installation part of the printer, the ribs guide the ink cartridge to be smoothly inserted, so that the fluid outlet is smoothly jointed with the fluid inlet of the printer; and meanwhile, the ribs limit movement of the ink cartridge in the left and right directions.

Figure 2A:
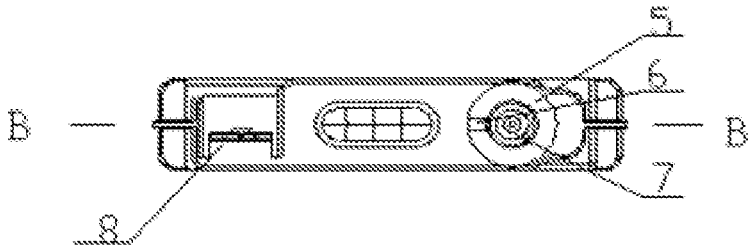
FIG. 2A is a main view of the ink cartridge of the embodiment of the present invention in a fluid outlet direction.
Figure 2B:
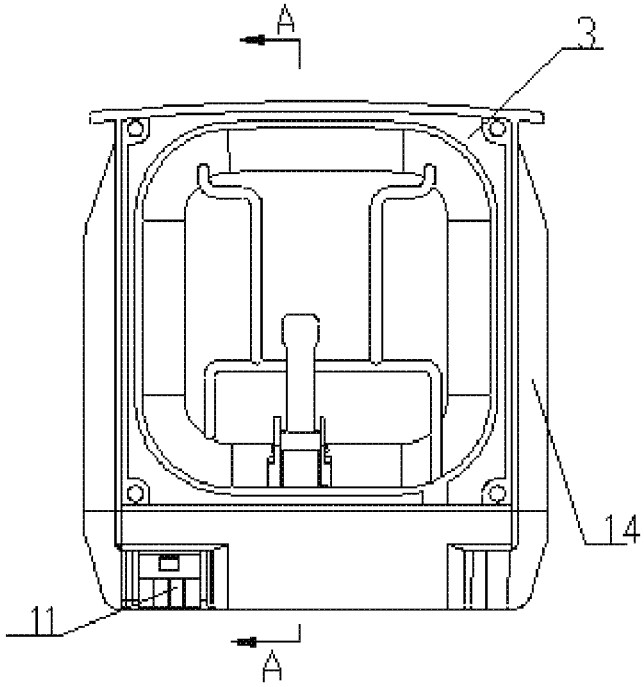
FIG. 2B is a section view of the ink cartridge of the embodiment of the present invention in a B-B direction of FIG. 2A.
Figure 2C:
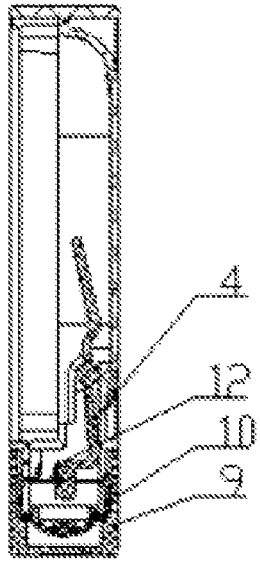
FIG. 2C is a section view of the ink cartridge of the embodiment of the present invention in an A-A direction of FIG. 2B.

FIGS. 2A, 2B and 2C further show the structure of the ink cartridge from respective directions.

Figure 3A:
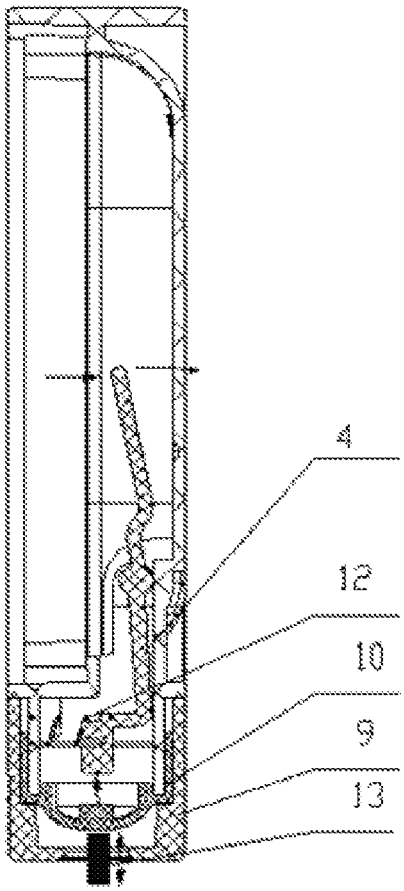
FIG. 3A is a position schematic diagram of an ink detection mechanism of the embodiment of the present invention when the ink cartridge has ink.

FIG. 3A shows a position of the ink detection mechanism when the ink cartridge has ink. When the ink cartridge has ink, an upper part of the lever component 4 is in a free state. Because a small spring 12 applies a certain pressure to a lower part of the lever component 4, the lever component 4 is positioned at the position as shown in FIG. 3A. At the moment, the pressure detection device 13 of the printer applies a certain pressure to the force transmission component 10, and the force transmission component 10 is elastically deformed under the pressure and connected with the lever component 4, so that the pressure applied by the pressure detection device 13 of the printer is transmitted to the lever component 4. The lever component 4 prevents the further movement of the pressure detection device 13 of the printer, so that the printer prompts that the ink cartridge has ink.

Figure 3B:
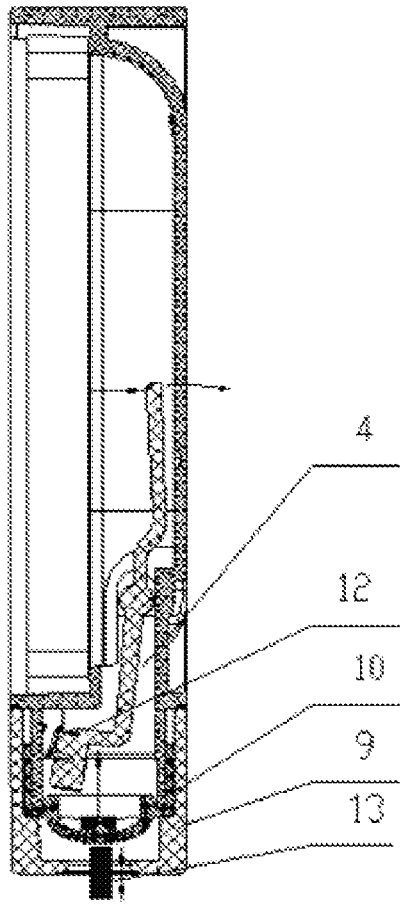
FIG. 3B is a position schematic diagram of the ink detection mechanism of the embodiment of the present invention when the ink cartridge has no ink.

When the ink in the ink cartridge is gradually consumed, the deformable film 2 substantially follows the concave shape of the concave housing 3 to press the upper part of the lever component 4, so that the lever component 4 moves in a direction as shown in FIG. 3A. When the lever component 4 moves to a position as shown in FIG. 3B, the ink in the ink cartridge is substantially used up. At this time, the pressure detection device 13 of the printer applies the pressure to the force transmission component 10, the force transmission component 10 is elastically deformed under the pressure, but the force transmission component 10 is not connected with the lever component 4 any more due to the movement of the lever component 4, so that the pressure applied to the force transmission component 10 by the pressure detection device 13 of the printer cannot be transmitted to the lever component 4, thus the pressure detection device 13 of the printer freely stretches in a predetermined range, and at the moment, the printer prompts that the ink in the ink cartridge is used up.

Finally, it should be noted that the above examples are merely provided for describing the technical solutions of the present invention, but not intended to limit the present invention. It should be understood by the ordinary skill in the art that although the present invention is described in detail with reference to the foregoing embodiments, modifications can be made to the technical solutions described in the foregoing embodiments, or equivalent replacements can be made to some technical features in the technical solutions, without the essence of corresponding technical solutions departing from the spirit and scope of the embodiments of the present invention.

What is claimed is:

1. An ink cartridge for an ink jet printer, comprising an ink storage chamber formed by a concave housing and a flexible and deformable film, a fluid outlet connected with a fluid inlet of the printer, an information storage device, a locking mechanism, and a detection mechanism for detecting ink consumption, wherein the detection mechanism comprises a lever component positioned in the ink storage chamber and a force transmission component positioned on the housing, made of deformable material and communicated with the ink storage chamber, when ink is received in the ink storage chamber, the force transmission component transmits a pressure applied by a pressure detection device of the printer to the lever component by means of deformation itself, and the lever component limits further movement of the pressure detection device of the printer to show that the ink cartridge has the ink; and when the ink in the ink storage chamber is gradually consumed to a predetermined value, the lever component is pressed by the flexible and deformable film and moves to a predetermined position, thus the force transmission component cannot transmit the pressure applied by the pressure detection device of the printer to the lever component, and the pressure detection device of the printer freely stretches in a predetermined range to prompt that the ink in the ink cartridge is used up.

2. The ink cartridge for the ink jet printer of claim 1, wherein the housing is provided with an elastic wall, and the information storage device is arranged on the elastic wall; and when the ink cartridge is installed in an installation position of the printer, the information storage device is engaged with a corresponding electric contact in the printer under a pretightening force applied by the elastic wall to form electric connection.

3. The ink cartridge for the ink jet printer of claim 1, further comprising positioning ribs arranged at two sides of the housing.

4. The ink cartridge for the ink jet printer of claim 3, wherein the positioning ribs at the two sides of the housing are symmetrically arranged.

5. The ink cartridge for the ink jet printer of claim 1, wherein when the ink cartridge is inserted into a specified position, the locking mechanism is caught in a corresponding part at the fluid inlet of the printer.

* * * * *